US007725301B2

(12) United States Patent
Shah et al.

(10) Patent No.: US 7,725,301 B2
(45) Date of Patent: May 25, 2010

(54) SYSTEM AND METHOD FOR ESTIMATING MULTI-PHASE FLUID RATES IN A SUBTERRANEAN WELL

(75) Inventors: Piyush C. Shah, Houston, TX (US); Kerry L. Kendrick, Houston, TX (US)

(73) Assignee: Welldynamics, B.V., Liederdorp (NL)

( * ) Notice: Subject to any disclaimer, the term of this patent is extended or adjusted under 35 U.S.C. 154(b) by 1999 days.

(21) Appl. No.: 10/287,744

(22) Filed: Nov. 4, 2002

(65) Prior Publication Data

US 2004/0084180 A1 May 6, 2004

(51) Int. Cl.
*G06G 7/48* (2006.01)
*G06G 7/50* (2006.01)

(52) U.S. Cl. ..... 703/10; 703/9

(58) Field of Classification Search ..... 703/9, 703/10

See application file for complete search history.

(56) References Cited

U.S. PATENT DOCUMENTS

| | | | | |
|---|---|---|---|---|
| 4,340,934 | A | 7/1982 | Segesman | |
| 5,329,811 | A * | 7/1994 | Schultz et al. | 73/152.02 |
| 5,586,027 | A | 12/1996 | Carlson et al. | |
| 5,960,369 | A | 9/1999 | Samaroo | 702/6 |
| 6,101,447 | A * | 8/2000 | Poe, Jr. | 702/13 |
| 6,618,677 | B1 | 9/2003 | Brown | 702/13 |
| 6,789,937 | B2 * | 9/2004 | Haddad et al. | 374/136 |
| 6,920,395 | B2 * | 7/2005 | Brown | 702/13 |
| 2002/0067373 | A1 * | 6/2002 | Roe et al. | 345/762 |
| 2003/0139916 | A1 * | 7/2003 | Choe et al. | 703/10 |
| 2005/0015231 | A1 * | 1/2005 | Edwards et al. | 703/10 |
| 2005/0149307 | A1 * | 7/2005 | Gurpinar et al. | 703/10 |

FOREIGN PATENT DOCUMENTS

GB 2 321 542 11/1997

OTHER PUBLICATIONS

Brownlee, Fred, et al., "Improving Well Completion System Reliability using Intelligent Well Technology," OTC 13029—Offshore Technology Conference, Apr.-May 2001, pp. 1-10.

* cited by examiner

*Primary Examiner*—Paul L Rodriguez
*Assistant Examiner*—Andre Pierre Louis
(74) *Attorney, Agent, or Firm*—Marlin R. Smith

(57) ABSTRACT

Methods and systems for estimating multi-phase fluid rates in a subterranean well (10). Stored and measured static (40) and transient (44) well conditions are used to model well conditions for comparison against additional transient data (42) relating to temperature, pressure, and flow. Multi-phase fluid rates are estimated by iteratively comparing well conditions with the model (30) for the well (10). Multi-phase fluid flow estimates may be obtained for the various liquid and gaseous fluids in the well (10) at multiple well locations (24).

13 Claims, 3 Drawing Sheets

10
32
33
35
30
31
37
22
20
14
16
18
34
26
28
27
24
12

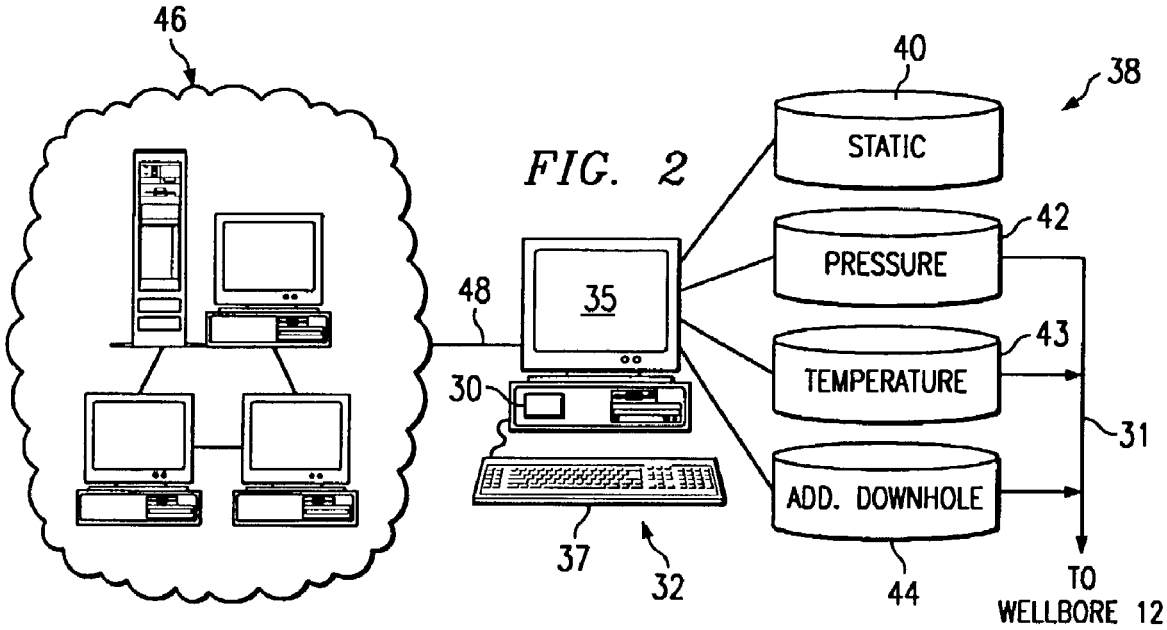
FIG. 4
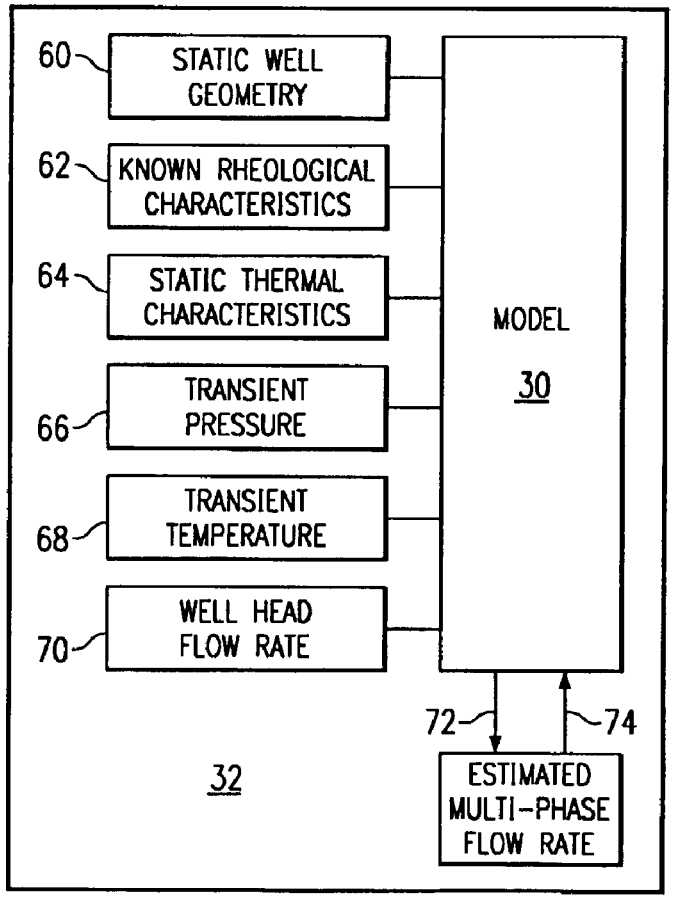

SYSTEM AND METHOD FOR ESTIMATING MULTI-PHASE FLUID RATES IN A SUBTERRANEAN WELL

TECHNICAL FIELD

The invention relates to methods and systems for estimating multi-phase fluid flow rates in a subterranean well. More particularly, the invention relates to methods and systems that provide estimates of multi-phase fluid flow rates using modeling based on static and transient well characteristics.

BACKGROUND OF THE INVENTION

In subterranean oil and gas wells, rates and volumes of fluids and gases are typically measured by meters and other physical means at the surface. Multi-phase fluid flow is a term used in the industry to indicate that gas, oil and water may be flowing in various combinations. For example, it is known to use a capacitance-probe technique or turbine flow meter or a combination of multiple techniques to measure the amount of free water and oil or gas passing through the well-head. Such measurements may be used to continuously monitor total oil production, to measure co-mingled production streams, and to determine total water, oil and gas production for the well. It is also known in the art to obtain data from downhole with remote sensors such as temperature or pressure transducers or flow meters. Such data is stored in downhole memory and replayed after the tools are retrieved from the well. Such measurements may also be obtained and transmitted to the surface in real time.

Production estimation is generally performed by direct measurements of production rates, over time, at the surface of the well. Pressure and temperature conditions are sometimes used to adjust metered gas or liquid per volume measured at the surface. Problems arise, however, due to an inability of current systems and methodology to obtain measurements of downhole multi-phase flow rates near where fluids first enter the wellbore. Problems associated with the inability to determine multi-phase fluid rates include, but are not limited to, limitations on assessing the efficiency of production and injection operations, incomplete information for planning remedial operations, and inaccuracies in logging production from the various production zones within the well.

Improvements in the ability to determine downhole multi-phase fluid rates would result in better monitoring of the various production streams within the well despite their becoming co-mingled at the surface and in making decisions concerning well management, such as injection and stimulation decisions. Methods and systems capable of providing timely and accurate estimates of multi-phase fluid rates would be useful and desirable in the arts for enhancing multi-phase flow profiling, improving production, improving monitoring of production and injection operations, and making workover and stimulation decisions.

SUMMARY OF THE INVENTION

In general, the invention provides methods and systems for estimating multi-phase fluid flow rates in a subterranean well using modeling based on static and transient well characteristics.

According to one aspect of the invention, a method of estimating multi-phase fluid flow rates in a subterranean well includes steps for measuring static and transient conditions in the subterranean well and for modeling the subterranean well using the measured conditions. The multi-phase fluid flow rates are estimated by iteratively comparing measured static and transient well conditions with the model for the well.

According to yet another aspect of the invention, temperature measurements are included in the model.

According to yet another aspect of the invention, pressure measurements are included in the model.

According to still another aspect of the invention, estimated multi-fluid flow rates are provided for a plurality of selected well locations.

According to another aspect of the invention, the transient measuring steps and modeling steps are performed in real time.

According to another aspect of the invention, the method of estimating multi-phase fluid flow rates in a subterranean well includes steps for measuring the static physical, rheological and thermal characteristics of the subterranean well. The rheological properties are of the fluid and not of the wellbore. These properties are measured as function of pressure and temperature. Steps are also provided for measuring the transient temperature, pressure and wellhead flow rate. The subterranean well is modeled using these measurements to estimate multi-phase fluid flow rates in the subterranean well.

According to still another aspect of the invention, the methods include steps for selecting a tolerance level for the match between the measurements and the model response and reiterating the modeling step until the tolerance level is met.

According to yet another aspect of the invention, the step of measuring and interpreting the transient temperature characteristics of the subterranean well includes modeling conductive and convective heat flow within the subterranean well.

Also disclosed is a system for estimating multi-phase fluid flow rates in a subterranean well. The system includes a computer with user input means, display means and software that operates in accordance with the methodologies of the invention. The software includes a multi-phase fluid flow rate program having a simulation model adapted for receiving data inputs corresponding to pressure and temperature measurements and for calculating a plurality of fluid flow rates from multi-phase fluids in a subterranean well.

According to another aspect of the invention, the system includes a data path extending from a computer into the subterranean well for coupling a plurality of temperature and pressure sensors to the computer in order to deliver pressure and temperature measurements from within the subterranean well to the computer.

Technical advantages are provided by the invention, including but not limited to improved speed and accuracy in providing multi-phase fluid rate estimates. Use of the invention also results in further advantages in terms of well productivity and control.

BRIEF DESCRIPTION OF THE DRAWINGS

For a better understanding of the invention including its features, advantages and specific embodiments, reference is made to the following detailed description along with accompanying drawings in which:

FIG. 2 is a block diagram showing the functional elements of a system for estimating multi-phase fluid rates according to one embodiment of the invention;

FIG. 4 is a block diagram showing the inputs to a model and illustrating the process of estimating multi-phase flow rate according to the invention.

References in the detailed description correspond to like references in the figures unless otherwise noted. Like numerals refer to like parts throughout the various figures. The descriptive and directional terms used in the written description such as top, bottom, left, right, etc., refer to the drawings themselves as laid out on the paper and not to physical limitations of the invention unless specifically noted. The drawings are not to scale and some features of embodiments shown and discussed are simplified or exaggerated for illustrating the principles of the invention.

DETAILED DESCRIPTION OF PREFERRED EMBODIMENTS

While the making and using of various embodiments of the present invention are discussed in detail below, it should be appreciated that the present invention provides many applicable inventive concepts which can be embodied in a wide variety of specific contexts. It should be understood that the invention may be practiced with computer or software platforms of various types and using various machine readable instruction languages without altering the principles of the invention. Those skilled in the arts will also recognize that the practice of the invention is not limited to a particular subterranean well geometry, production apparatus or method, or sensor technology.

Figure 1:
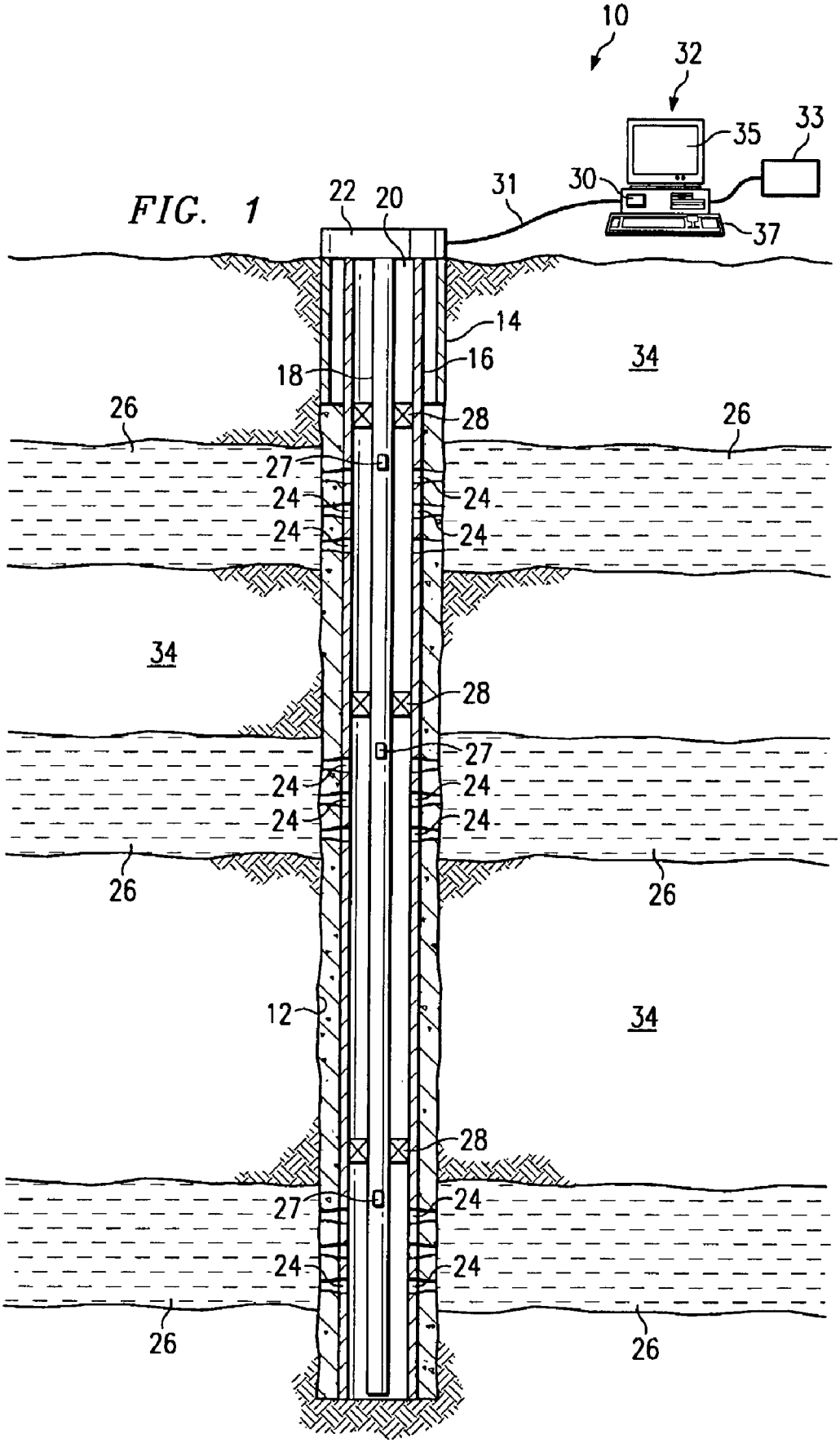
FIG. 1 is a block diagram showing a cutaway view of a subterranean well illustrating use of the methods and systems of the invention according to one embodiment.

Referring to FIG. 1, in general, subterranean well 10 begins with a wellbore 12 lined with multiple concentric tubular members 14, 16 and 18. Generally, the inner member 18 terminates at successively deeper locations as compared to outer members 14 and 16. The annular space 20 between the consecutive tubular members 18 and 16, for example, may be filled with cement or some other solid, liquid or gas, or a combination of columns of solids and fluids. Fluid flow may be upwards or downwards in the innermost tubing 18 or in any of the outer annular spaces 20, with possible simultaneous flow of fluids in either direction. Although a simplified vertical wellbore 12 is described for the sake of example, it will be understood that the wellbore 12 may also be angled, horizontal, or a combination of horizontal and vertical segments.

Uphole production flow toward the wellhead 22 typically includes multiple measured-depth-separated entries 24 which carry fluid, typically deep within the well 10. It is well known that each of the entries 24 has its own fluid phase (whether it be oil, water or gas), flow rate, temperature, and hydrocarbon-mixture composition. For example, as fluids enter the production flow path defined by innermost tubing 18, through different entries 24, they typically mix and travel uphole as a combined composition. Typically, fluid flow rate and fluid composition vary over different segments of the well 10, including the spaces defined by the entry locations 24, the production zones 26, and the wellhead 22. Commonly, the well 10 may be segmented by packers 28 in order to control the pressure and flow characteristics of the production stream 20 at the various entry points 24. Preferably, a plurality of sensors 27 are deployed to take measurements at the various production zones 26 or other points of interest inside the wellbore 12. The sensors 27 are preferably downhole temperature and pressure transducers coupled to a computer 32 by a wireline or wireless telemetry path 31. The sensors 27 may include, but are not limited to, fiber optic distributed temperature sensing ("DTS") systems, thermocouples, and thermistors as well as pressure transducers known in the art.

According to the invention, the computer 32 incorporates the functionality of a mathematical model 30 designed to simulate the physical processes of the flow of multi-phase fluid, which typically consists of oil, gas and/or water within the wellbore 12. As used herein, the term "multi-phase fluid flow" will include fluid flow with just one phase, as well as fluid flow with two or more phases. Preferably this model 30 resides in a computer 32 and is provided with data 33 relating to known physical laws and standard geological and rheological data. The computer 32 typically includes display 35 and input devices 37.

As explained in more detail below, the model 30 takes into account the conservation of energy and mass, and consequently simulates the evolution of the temperature of the flowing fluid, the properties of the static well 10 and the tubular members 14, 16, 18, the stationary contents of the various annular spaces 20, and the geological formation rock 34 surrounding the wellbore 12. It is known that pressure and temperature of the flowing fluids change as they travel up or down a flow path inside a tubular 18 or, for example, in the annular space 20 as a result of heat conduction, heat convection, heat generation due to friction, heat absorbed or heat released due to the evaporation of the liquid phase (oil and/or water) or condensation of the gas phase. Therefore, model 30 should take such factors into consideration. Transient pressure changes due to both hydrostatic and dynamics of the flow as well as fluid friction are also included in the model 30, and model 30 may include two or more simultaneous fluid flows in different flow paths, and each flow may be either uphole or downhole. As used herein, the term "transient" shall apply to those conditions where a sudden change in flow rates is due to one or more changes in the setting of the surface or downhole flow controls. The flow rate at each entry location 24 is assumed to stay constant or change slowly and monotonically in a predictable manner after resetting of the flow controls. In the constant flow case, no significant change in the flow rate at each entry location 24 is assumed to occur over the period of time in which the transient measurements are made. The temperature at each sensor location changes over time due to readjustment of the heat exchange between the wellbore flow and the surrounding formation. The pressure will also change in association with the temperature changes.

Thermodynamic calculations based upon physical laws known in the arts are preferably used to help determine the partition of the hydrocarbon mass between the liquid (e.g. oil) and gas phases. The thermodynamic calculations are also used along with published laboratory measurements of different fluid property parameters to calculate the various physical properties of each fluid phase. Preferably, the parameters, density, viscosity, specific heat capacity, and heat conductivity applicable to the well 10 are determined for use with the model 30.

The user-specified geometry of the well 10 and its construction is used to constitute the static physical domain over which the flow and heat equations are solved. The surrounding rock 34 is included in the domain for calculation of the transient heat flow. The geological temperature distribution versus the depth in the wellbore 12 is typically used as a starting condition and a boundary condition for the heat flow computations. The user of the invention may specify, using a computer input device such as a keyboard 37, the mass flow rate of each phase and the temperature at each entry point 24 within the well 10. The fluid pressure may be specified at each one of the entries 24 or at the wellhead 22.

A better understanding of the invention may be obtained by reference to FIG. 2, which shows a block diagram for a system, denoted generally as 38, according to the invention that utilizes multi-phase fluid flow rate model 30 in estimating multi-phase fluid flow rates in a subterranean well. Typically, the system 38 can take the form of software residing on a computer 32, although it may alternatively reside in a network 46, which may be coupled to the computer 32 through a communications link 48. The model 30 may be stored by generally available means for storing pre-programmed, machine readable instructions, as known in the art.

A data path 31 extends into the wellbore 12. The data path 31 supplies transient data to the model 30, such as, for example, measured pressure data 42 and temperature data 43 measured at multiple downhole locations. Additional data 44 relating to the transient conditions of the well may also be provided, such as, for example, whether particular valves have been opened or closed or whether particular production fluids have been introduced into the wellbore 12. Additionally, static data 40, such as data describing physical laws and properties of oil configurations and/or materials may also be provided to the model 30. Although the compilations of data are shown separately in FIG. 2, the data may reside in computer 32 or elsewhere, such as in an external database distributed throughout the network 46. It should also be understood that the computer 32 may be located at the wellhead or offsite many miles away.

In the model 30, a method of finite difference is preferably used to solve the partial differential equations known in the arts for fluid flow and heat flow. The well domain is subdivided with a grid that covers the vertical and radial spatial domain. The time evolution of the flow and heat variations over the spatial domain are calculated by subdividing the time in variable steps. At each time step, the fluid flow along the flow path is calculated using an explicit method of solution. The heat flow equation is preferably solved using the Alternate Direction Implicit ("ADI") method known in the arts, although other techniques may be used.

Figure 3:
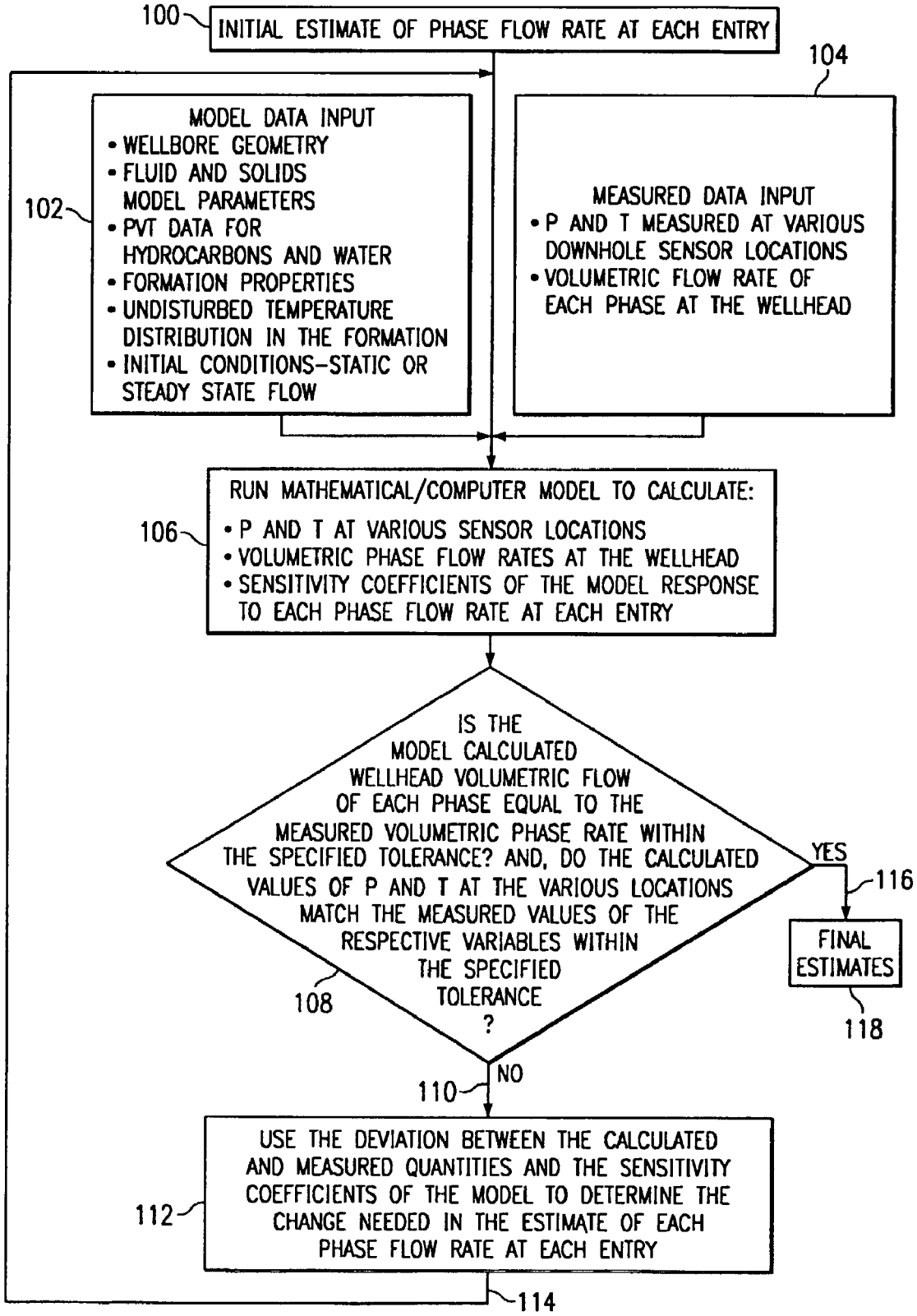
FIG. 3 is a process flow diagram illustrating the methods of estimating multi-phase fluid rates in a subterranean well according to one embodiment of the invention.

FIG. 3 is a process flow diagram illustrating a preferred implementation of the method of multi-phase fluid rate of the invention operating using the preferred techniques described above. As shown at step 100, an initial estimate of the flow rate from each stratum or zone to be produced is acquired and input to the calculations. At step 102, static data, preferably including properties of the well 10 such as the geometry of the wellbore 12, properties of well fluids and solids, Pressure/Volume/Temperature ("PVT") data for hydrocarbons and water, formation properties, and undisturbed temperature distribution in the formation is entered into the model 30. Initial conditions from the well bore may be entered into the model 30 as well. The initial conditions may either be initial static conditions or initial steady-state flow conditions.

In circumstances where neither the static temperature profile for a zero flow condition is known, nor an initial flowing condition temperature profile is known, the model 30 may be loaded with an initial condition data set from another source. A non-limiting example of such an initial condition data set may be when a service company arrives at a well site which has already installed temperature and/or pressure sensors, and the well is already flowing, and opportunity for shutting the well or running a production log does not exist or is cost prohibitive. The service company may interface to a surface box which receives the measurements from the DTS and/or pressure sensor outputs, and take an "initial condition" reading set while the well is in production flow. This initial condition reading set is then inputted into the model 30 along with "initial" flow profile derived from a separate theoretical model, actual offset well data, field/reservoir empirical model, field or reservoir statistics, or any alternative modeling approach. From this starting point, measured changes in the temperature and pressure profile over time is inputted into the iterative model 30. Of course, other parameters germane to a particular well may also be input for incorporation into the model 30.

As used herein, the term "steady-state flow" shall apply to those situations where after a long period of production, the flow-rates from the different entries 24 have settled down to constant values, as have the pressure and temperature profiles in any wellbore flow path. The well is now in a steady-state condition (or nearly so, so that it can be modeled using a steady-state solution to the simulation problem) at the start of the measurement process. Steady-state flow data may be used as the initial condition of the model 30, from which the subsequent transient flow can be assumed to occur and modeled. Thus, the steady-state flow condition may replace the "static" initial condition. Additionally, the initial steady-state multi-phase flow rates entering the wellbore 12 at each entry point 24 may be estimated along with the same flow rates after the change that caused the transient condition.

Transient well data is measured, step 104, preferably including pressure and temperature data in the wellbore 12 above each flow entry being produced. It should be understood that the measurement above each flow entry is not required for the solution of the inverse problem. Pressure and temperature measurements may also be obtained for various other locations downhole and at the wellhead 22. Volumetric flow rate measurements for each phase at the wellhead 22 are also obtained. In step 106, the mathematical model for the wellbore 12 is run to calculate the expected pressure and temperature values at the downhole sensor locations, the expected volumetric phase flow rates at the wellhead 22, and sensitivity coefficients of the model response to each phase flow rate at each fluid entry location.

With continued reference to FIG. 3, in step 108, the expected wellhead volumetric flow of each phase calculated in step 106 is compared with the measured volumetric phase flow rate obtained in step 104. Also in step 108, the model-calculated expected pressure and temperature values for various well locations of step 106 are preferably compared with the measured temperature and pressure values obtained in step 104 with respect to those same well locations. Thus, at step 108, the actual transient data is compared with the calculated expectations of the model. Preferably, acceptable tolerance levels are preselected for the comparisons.

As shown by arrow path 110, in step 112, the deviation between the calculated and measured quantities (of step 108) may be used with the sensitivity coefficients of the model (from step 106) to determine changes necessary for the estimate of phase flow rates at each well entry point. In this way, the modeling comparisons may be reiterated, following arrow path 114, until an approximate match (within acceptable tolerances) is obtained between the calculated well properties and related flow rates and the measured well properties and flow rates. As shown by arrow path 116, if the measured volumetric phase rates and pressure and temperature readings are in tolerable agreement with the expected values predicted by the model 30, the final estimates of the multiphase flow rates are provided as shown at step 118.

FIG. 4 is an architectural block diagram showing the various inputs used by a model, such as model 30, which can be used by system 38 for estimating multi-phase fluid flow rates according to the invention. As shown in FIG. 4, the model 30 may reside on a computer 32. Of course, it is contemplated that the computer 32 may actually take the form of multiple computers linked in a distributed computer network and that the model 30 may be accessed and implemented either at the wellhead 22 or offsite.

Static physical characteristics 60 of the subterranean well are measured, such as well geometry, and are provided to the model 30. Similarly, known rheological characteristics of fluids being produced by or introduced into the well are provided to the model at block 62. Static thermal characteristics, represented by block 64, of both the wellbore 12 and the surrounding formation and fluids are also provided to the model 30. Preferably, as shown at blocks 66 and 68 respectively, transient pressure and transient temperature are measured at a plurality of locations downhole for provision to the model 30. Of course, the relationship between pressure and temperature may also be used to supplement or substitute for selected transient pressure and temperature data.

Preferably, as shown in box 70, the wellhead flow rate is also provided to the model 30. The transient data, in this example represented by blocks 66, 68 and 70, are provided continuously to the model 30 or may be provided at regular intervals. The model 30 uses the static or steady-state flow initial condition data and measured transient data as are available to solve for estimated multi-phase flow rates as indicated at block 72. The estimated multi-phase flow rate 74 may also be used in an iterative process to adjust the model 30.

Thus, the invention uses static or steady-state flow initial condition data and measured transient data as are available to create a model 30 for the particular well as indicated at block 72. Using the model and ongoing measurements collected from the well, the systems and methods of the invention determine accurate and timely estimates of downhole multiphase fluid rates thereby providing significant advantages in improved multi-phase flow profiling, production monitoring, and injection, work-over and stimulation decisions.

The embodiments shown and described above are only exemplary. Even though numerous characteristics and advantages of the present invention have been set forth in the foregoing description together with details of the method and device of the invention, the disclosure is illustrative only and changes may be made within the principles of the invention to the full extent indicated by the broad general meaning of the terms used in the attached claims.

We claim:

1. A method of estimating multiphase fluid flow rates in a subterranean well, the method comprising the steps of:

inputting static physical characteristics of the subterranean well;

inputting rheological characteristics of produced and static fluids present in the well;

inputting static thermal characteristics of the subterranean well;

inputting transient temperature conditions of the subterranean well;

inputting transient pressure conditions of the subterranean well;

inputting wellhead flow rate; and modeling the subterranean well using the rheological characteristics, the transient temperature and pressure conditions and the wellhead flow rate to estimate the multiphase fluid flow rates in the subterranean well, wherein the step of inputting the transient temperature conditions of the subterranean well further comprises the steps of inputting conductive heat flow rate and inputting convective heat flow rate.

2. The method of claim 1 wherein the modeling step further comprises the step of calculating an initial flow rate estimate of multiphase fluids in the subterranean well.

3. The method of claim 1 further comprising the steps of:

selecting a tolerance level for a match between a model response and measured well behavior; and reiterating the modeling step until the tolerance level is met.

4. The method of claim 1 wherein the inputting transient temperature conditions step further comprises the step of inputting transient temperature from a plurality of locations within the subterranean well.

5. The method of claim 1 wherein the inputting transient pressure conditions step further comprises the step of inputting pressure characteristics from a plurality of locations within the well.

6. The method of claim 1 further comprising the step of providing estimated multiphase fluid flow rates for a plurality of locations within the well.

7. The method of claim 1 wherein the estimate of multiphase fluid flow rates in the subterranean well is provided in real-time.

8. The method of claim 1 further comprising the steps of:

inputting the wellhead fluid temperature; and using the wellhead fluid temperature in the modeling step.

9. The method of claim 1 further comprising the steps of:

inputting the wellhead fluid pressure; and using the wellhead fluid pressure in the modeling step.

10. A method for estimating multiphase fluid flow from two or more locations in a well, the method comprising:

obtaining flow rates of oil, water and gas flowing from a wellhead;

obtaining temperature measurements at the two or more locations in the well, producing a computer model of temperature profile in the well as a function of the oil, water and gas flowing through the well to the wellhead, and inputting the flow rates from the wellhead and the temperature measurements into the model and producing an estimate of flow of the oil, water and gas into the well at the two or more locations in the well.

11. The method of claim 10, further comprising:

including in the computer model a pressure profile in the well as a function of the oil, water and gas flowing through the well to the wellhead, obtaining pressure measurements at one or more locations in the well, and inputting the pressure measurements into the model.

12. A method for estimating multiphase fluid flow from two or more locations in a well, the method comprising:

obtaining temperature measurements at the two or more locations in the well, producing a computer model of temperature profile in the well as a function of oil, water and gas flowing through the well to a wellhead, and iteratively inputting into the computer model estimated flow rates of the oil, water and gas flowing at the two or more locations in the well until temperatures predicted by the computer model are about the same as the temperature measurements obtained at the two or more locations in the well.

13. The method of claim 12, further comprising:

including in the computer model a pressure profile in the well as a function of the oil, water and gas flowing through the well to the wellhead, obtaining pressure measurements at one or more locations in the well, and iteratively inputting into the computer model the estimated flow rates of the oil, water and gas flowing at the two or more locations in the well until pressures predicted by the computer model are about the same as the pressure measurements obtained at the one or more locations in the well.

* * * * *